United States Patent [19]

Bunn et al.

[11] 4,043,710

[45] Aug. 23, 1977

[54] COMPRESSOR UNLOADER ASSEMBLY

[76] Inventors: Stuart E. Bunn; Herbert B. Owsley, both of P. O. Box 388, Shawnee Mission, Kans. 66201

[21] Appl. No.: 712,927

[22] Filed: Aug. 9, 1976

[51] Int. Cl.[2] ..... F04B 23/00

[52] U.S. Cl. ..... 417/440; 92/60.5; 417/442

[58] Field of Search ..... 92/60.5; 417/274–277, 417/295, 305, 440, 441, 442, 456, 457, 458, 503; 60/481, 482, 468

[56] References Cited

U.S. PATENT DOCUMENTS

| | | | |
|---|---|---|---|
| 1,158,321 | 10/1915 | Shipley | 417/441 X |
| 2,393,405 | 1/1946 | Page | 60/481 |
| 2,690,868 | 10/1954 | Gehres | 92/60.5 X |
| 3,295,748 | 1/1967 | Leitgeb | 92/60.5 X |

*Primary Examiner*—William L. Freeh

*Assistant Examiner*—Edward Look

*Attorney, Agent, or Firm*—Fishburn, Gold & Litman

[57] ABSTRACT

An unloader assembly for a gas compressor having a compressor suction chamber and a compressor cylinder with a compressor piston slideable therein for effecting one-way gas flow through a suction valve assembly mounted in the compressor suction chamber, said suction valve assembly having a central passage therethrough. An unloader piston is slideably movable in the central passage of the suction valve between a first position closing a plurality of ports in the suction valve each providing communication between the suction chamber and the suction valve central passage and a second position opening the ports. A clearance bottle is mounted on the compressor and a valve controlled aperture permits communication between the suction chamber and the clearance bottle until closed by a clearance bottle valve.

13 Claims, 3 Drawing Figures

COMPRESSOR UNLOADER ASSEMBLY

The present invention relates to compressor cylinder unloaders and more particularly to a compressor unloader assembly having a tubular piston permitting communication therethrough between a compressor suction chamber and a clearance.

The principal objects of the present invention are: to provide a compressor unloading assembly adapted for partial and complete unloading of a suction valve in a suction chamber and adapted to permit one-way flow into a compressor cylinder; to provide such a compressor unloading assembly including a clearance bottle communicating with the compressor suction chamber and having a valve selectively opening the clearance bottle for increased clearance; to provide such a compressor unloading assembly including an unloader piston slideable in a suction valve central passage to selectively open ports communicating the suction chamber and the clearance bottle for unloaded operation; to provide such a compressor unloading assembly particularly adapted for use with double deck suction valves having a plurality of circumferentially spaced radially extending ports communicating with a central passage therethrough so that at least a portion of gas flow through the suction valve is through the central passage; to provide such an unloading assembly wherein an unloader piston is positioned in a suction valve central passage and has a bore therethrough to permit flow through the piston during unloaded operation; and to provide such an unloading assembly which is economical to manufacture, easily maintained and installed, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the compressor unloader assembly.

Figure 1:
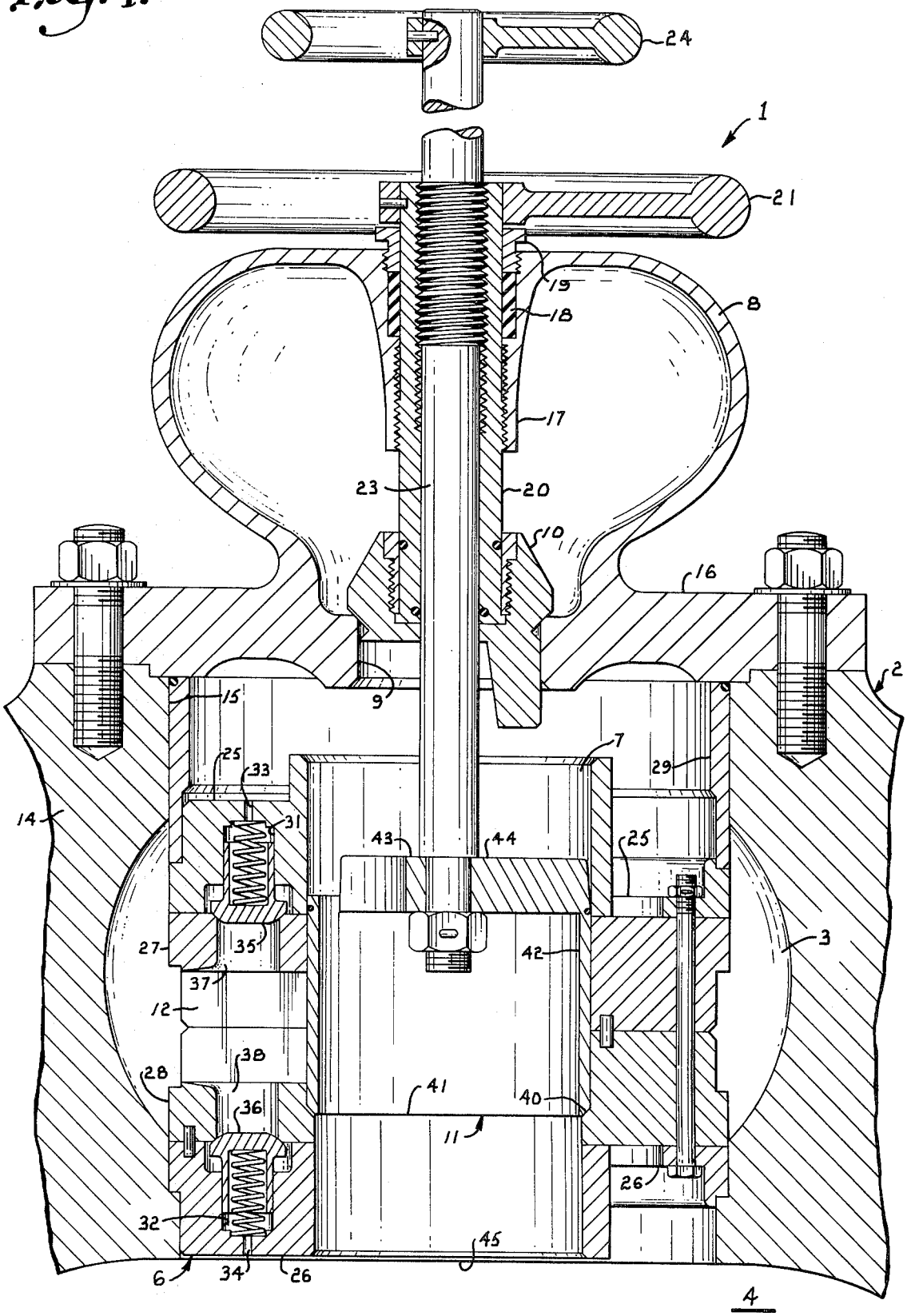
FIG. 1 is a fragmentary sectional view of a compressor cylinder and suction valve therefor and showing an unloader assembly embodying features of the present invention and positioned for loaded operation.
Figure 2:
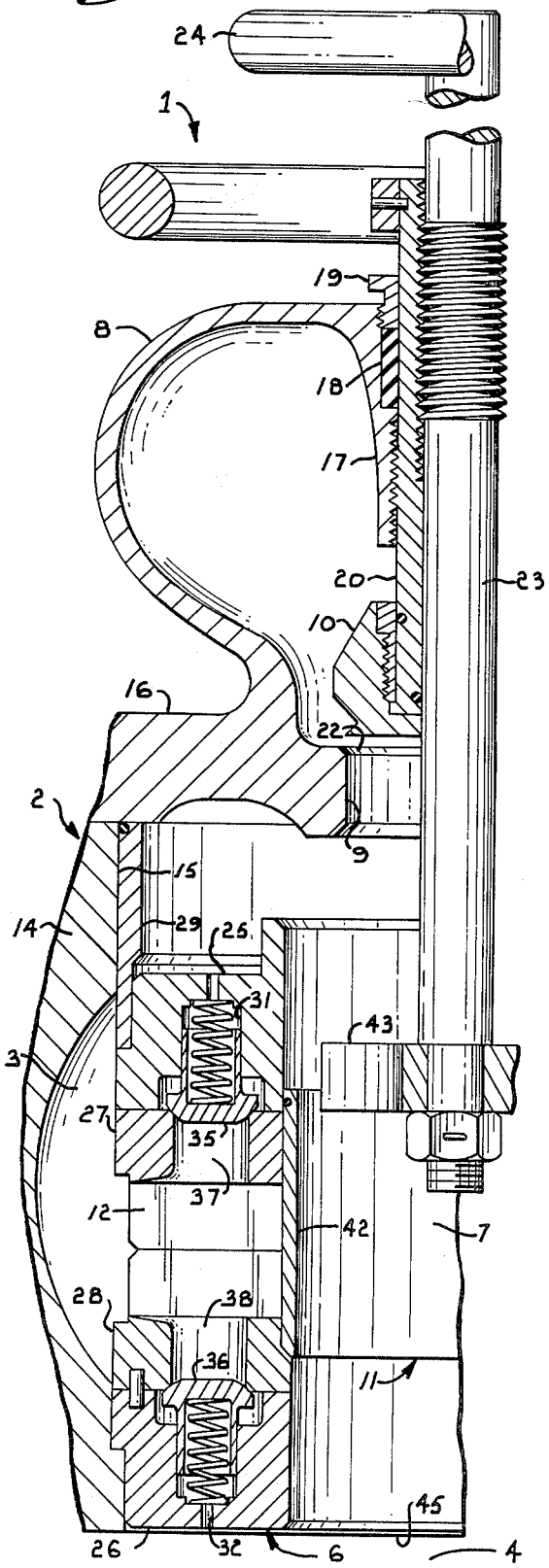
FIG. 2 is a fragmentary sectional view similar to FIG. 1 except showing the unloader assembly positioned for increased clearance.
Figure 3:
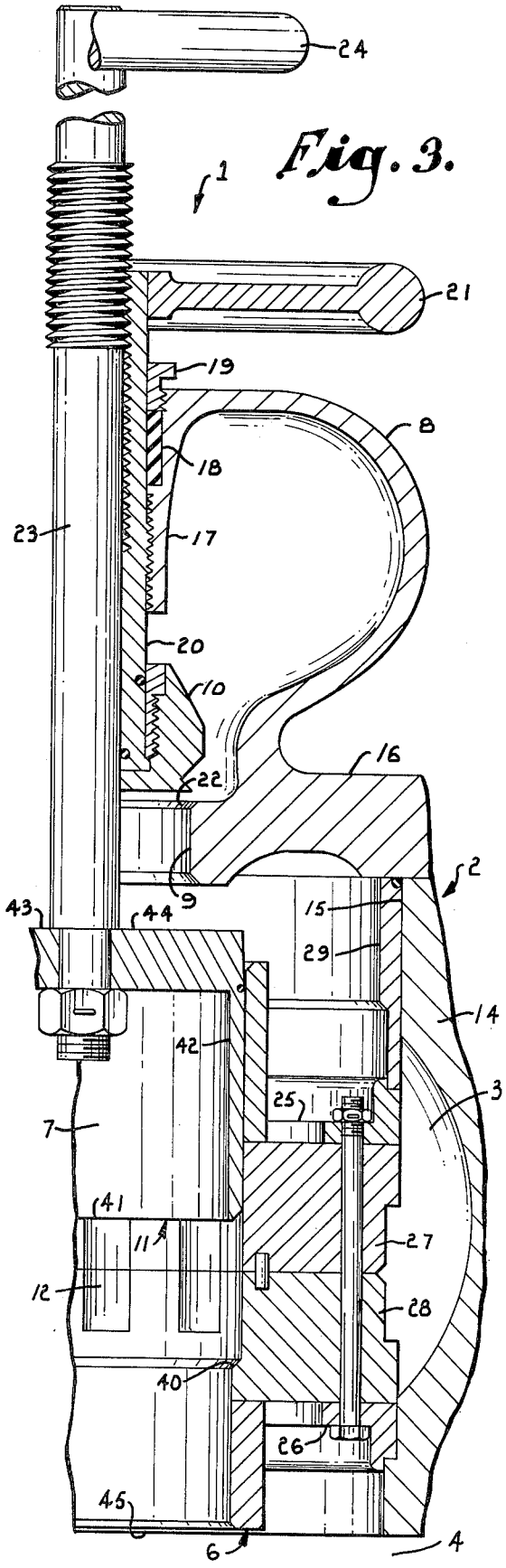
FIG. 3 is a fragmentary sectional view similar to FIGS. 1 and 2 except showing the unloader assembly positioned for unloaded operation.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a compressor unloader assembly for a gas compressor 2 having a compressor suction chamber 3 and a compressor cylinder 4 with a compressor piston slideable therein for effecting one-way gas flow through a suction valve assembly 6 mounted in the compressor suction chamber 3 and having a central passage 7 therethrough. The unloader assembly 1 illustrated includes a clearance bottle 8 mounted on the compressor 2 and having an aperture 9 permitting communication between the suction chamber 3 and the clearance bottle 8 until closed by a clearance bottle valve 10. An unloader piston 11 is slideably movable in the central passage 7 of the suction valve 6 and between a first position closing a plurality of ports 12 in the suction valve 6 each providing communication between the suction chamber 3 and the suction valve central passage 7 and a second position opening the ports 12.

The gas compressor 2 has a frame 14 with respective walls thereof defining the suction chamber 3 and the compressor cylinder 4. The walls defining the suction chamber 3 also define an opening 15 in an exterior surface which is closed by a mounting flange 16 of the clearance bottle 8 with the flange 16 having the aperture 9 therein.

The clearance bottle 8 may be any suitable structure connected in a manner to provide selective variation of the volume of the compressor cylinder and as illustrated, includes a tubular inwardly extending neck portion 17 thereby defining a second aperture in the clearance bottle 8. The neck portion 17 is internally threaded and has suitable packing material 18 and a packing gland 19 mounted therein. The neck portion 17 is aligned with the aperture 9 through the mounting flange 16.

The clearance bottle valve 10 is adapted to selectively open and close the clearance bottle aperture 9. The clearance bottle valve 10 is mounted on one end of an elongated valve shaft 20 received in the tubular neck portion 17 with the packing material 18 and the packing gland 19 in sealing engagement with the valve shaft 20. A portion of the length of the valve shaft 20 is externally threaded for cooperative engagement with the threads on the internal surface of the neck portion 17 whereby turning of the valve shaft 20, as by a hand wheel 21 by an operator, moves the valve 10 into and out of seating engagement with a valve seat 22 surrounding the aperture 9.

The valve shaft 20 is tubular and adapted to be sleeved on an elongated activating shaft 23 having the unloader piston 11 mounted on one end thereof. The activating shaft 23 extends through the aperture 9 and through the neck portion 17 defining the second aperture. An interior surface of the tubular valve shaft 20 and a portion of the exterior surface of the activating shaft 23 have co-operating threads thereon whereby relative movement between the valve shaft 20 and the activating shaft 23 may be effected by holding the hand wheel 21 while turning a hand wheel 24 mounted on the other end of the activating shaft 22.

The suction valve 6 shown is a double-deck structure positioned in the suction chamber 3 of the gas compressor 2. The suction valve 6 has the central passage 7 therethrough aligned with the aperture 9 and the suction valve 6 has surfaces defining a plurality of circumferentially spaced ports 12 providing communication between the suction chamber 3 and the suction valve central passage 7. The suction valve 6 is adapted to permit one-way flow from the compressor suction chamber 3 to the compressor cylinder 4 with at least a portion of the flow being through the suction valve central passage 7.

The illustrated suction valve 6 is a double-deck structure having first and second valve cages 25 and 26 adapted to have first and second valve plates or valve seats 27 and 28 positiond in abutting engagement therebetween. The first and second valve cages 25 and 26 and the first and second valve plates 27 and 28 are formed to have the central passage 7 therethrough and may be retained together in abutting engagement as a unit in a conventional manner, as by plurality of circumferentially spaced bolts and nuts.

The suction valve unit or assembly 6 is suitably retained in the suction chamber 3 ofthe gas compressor 2. In the illustrated embodiment, one of the cages, for example the second valve cage 26, and one of the walls of the compressor frame 14 have facing shoulders to position the suction valve 6 aligned with an entrance to the compressor cylinder 4. The other or first valve cage 25 has an annular recess or outwardly facing shoulder engaged by a tubular valve chair 29 extending between the first valve cage 25 and the mounting flange 16 of the clearance bottle 8.

The first and second cages 25 and 26 have a plurality of circumferentially spaced guide bores 31 and 32 respectively. The guide bores 31 and 32 have vent bores 33 and 34 respectively communicating the guide bores 31 and 32 with the exterior surface of the suction valve 6.

Poppet valves 35 and 36 are resiliently mounted in the guide bores 31 and 32 in the first and second valve cages 25 and 26 in a manner similar to respective components of our MULTIPLE POPPET VALVE STRUCTURE illustrated and described in our U.S. Pat. No. 3,602,247 issued Aug. 31, 1971.

The first and second valve seats 27 and 28 have a plurality of circumferentially spaced flow passages 37 and 38 each aligned with a respective one of the guide bores 31 and 32 respectively and one of the ports 12. The ports 12 each extend radially between an exterior and an interior surface of the seats 27 and 28 thereby providing communication between the suction chamber 3 and the central passage 7 through the suction valve 6 and thereby bypassing the poppet valves 35 and 36.

The unloader piston 11 is slideable in the central passage 7 of the suction valve assembly 6 and is positioned in a first position closing the ports 12 in the suction valve 6 when normal or loaded operation is desired. The second valve cage 26 has an inwardly extending portion thereby defining a seat or shoulder 40 adapted to be engaged by one end 41 of the unloader piston 11 when same is in the first position. The seat 40 and the unloader piston one end 41 have corresponding tapers thereby providing a positive seating engagement therebetween.

The unloader piston 11 is movable to a second position opening the ports 12 in the suction valve 6. The unloader piston 11 is generally a sleeve type piston with a wall member defining a large bore 42 therethrough to permit communication between the compressor suction chamber 3 and the space between the first valve cage 25 and the mounting flange 16 of the clearance bottle 8 when in the second position. The unloader piston 11 also permits flow through the ports 12 in the suction valve 6 when in the second position and thereby communication between the suction chamber 3 and the compressor cylinder 4 by bypassing the poppet valves 35 and 36. The illustrated unloader piston 11 has a center mounting portion 43 suitably retained on the activating shaft 33 and a plurality of circumferentially spaced and radially extending fingers 44 connecting the mounting portion 43 and the piston wall.

In the illustrated embodiment, the tubular neck portion 17 of the clearance bottle 8 and the second aperture defined thereby, the aperture 9 in the mounting flange 16, the central passage 7 in the suction valve 6, the bore 42 through the unloading piston 11, and an entrance 45 of the compressor cylinder 4 are longitudinally aligned.

When normal or loaded operation of the gas compressor 2 is desired, the hand wheel 21 is turned as required to seat the bottle valve 10 on the seat 22 and thereby close the aperture 9 through the mounting flange 16 of the clearance bottle 8 and the hand wheel 24 is turned as required to seat the one end 41 of the unloader piston 11 on the seat 40 on the interior surface of the second valve cage 26.

When additional clearance is desired, the hand wheel 21 is turned to move the clearance bottle valve 8 out of seating engagement with the valve seat 22 around the aperture 9. Movement of the valve shaft 20 is not sufficient to move the unloader piston 11 to a position even partially opening the ports 12 in the suction valve 6.

When complete unloading is desired, the hand wheel 24 is turned to move the unloader piston 11 to the second position thereby opening the ports 12 in the suction valve 6 thereby bypassing the poppet valves 35 and 36 mounted in the first and second valve plates of the suction valve 6.

It is to be understood that while we have illustrated and described one form of our invention, it is not to be limited to the specific form or arrangement of parts herein described and shown.

What we claim and desire to secure by Letters Patent is:

1. An unloader assembly for use in a gas compressor having a compressor cylinder and a compressor piston slideable therein, said unloader assembly comprising:

a. a suction valve communicating a compressor suction chamber and a compressor cylinder, said suction valve having an interior surface defining a central passage therethrough and a plurality of circumferentially spaced ports communicating the suction chamber and the suction valve central passage, said suction valve being adapted to permit one-way gas flow from said compressor suction chamber to said compressor cylinder with at least a portion of the flow being through said suction valve central passage;

b. an unloader piston slideable in said suction valve central passage between a first position closing said suction valve ports and a second position opening said suction valve ports; and c. means operatively connected to said unloader piston for selectively moving said piston between the first position and the second position.

2. An unloader assembly as set forth in claim 1 including:

a. a clearance bottle communicating with the compressor suction chamber;

b. a clearance bottle valve; and c. means operatively connected to said clearance bottle valve for selectively moving same between a first position closing communication between the clearance bottle and the compressor suction chamber and a second position opening communication between said clearance bottle and the compressor suction chamber.

3. An unloader assembly as set forth in claim 2 wherein:

a. said clearance bottle has a mounting flange secured on a compressor housing and having an aperture therethrough;

b. said mounting flange has a valve seat around said aperture;

c. said means for selectively moving said clearance bottle valve between the first position and the second position includes an elongated tubular valve shaft having said clearance bottle valve mounted on one end thereof and mounted on said clearance bottle for moving said valve into and out of seating engagement with said seat around said aperture; and d. said means for selectively moving said piston between the first and second positions includes an elongated activating shaft slideably received in said tubular valve shaft and extending through said clearance bottle aperture.

4. An unloader assembly as set forth in claim 3 wherein:

a. said suction valve includes first and second valve plates positioned in abutting engagement and having said ports positioned therebetween and each having an entrance communicating with said compressor suction chamber and an exit communicating with said suction valve central passage;

b. one of said suction valve first and second valve plates has a seat on the interior surface thereof;

c. said piston has one end thereof adapted to be in seating engagement with said seat on the interior surface of said one of said suction valve first and second valve plates when in said first position; and d. said piston has a bore therethrough to permit communication between the compressor suction chamber and said clearance bottle when said piston is in said second position.

5. An unloader assembly as set forth in claim 1 wherein:

a. said suction valve includes first and second valve plates positioned in abutting engagement and having said ports positioned therebetween and each having an entrance communicating with said compressor suction chamber and an exit communicating with said suction valve central passage;

b. one of said suction valve first and second valve plates has a seat on the interior surface thereof;

c. said piston has one end thereof adapted to be in seating engagement with said seat on the interior surface of said one of said suction valve first and second valve plates when in said first position.

6. An unloader assembly for use in a gas compressor having a suction chamber and a compressor cylinder and a compressor piston slideable therein, said unloader assembly comprising:

a. a suction valve having first and second valve plates positioned in a suction chamber of a gas compressor, said first and second valve plates being in abutting engagement and each having an interior surface defining a central passage therethrough, said first and second valve plates having surfaces defining a plurality of circumferentially spaced ports each providing communication between the suction chamber and said suction valve central passage, said suction valve being adapted to permit one-way flow from the compressor suction chamber to a compressor cylinder with at least a portion of the flow being through said section valve central passage;

b. a clearance bottle having an aperture permitting communication between the compressor suction chamber and said clearance bottle, said aperture being aligned with said suction valve central passage;

c. a clearance bottle valve adapted for selectively opening and closing said clearance bottle aperture; and d. a piston movable in said suction valve central passage and adapted to selectively open and close communication between the suction chamber and the compressor cylinder through said suction valve ports.

7. An unloader assembly as set forth in claim 6 wherein:

a. one of said suction valve first and second valve plates has a seat on the interior surface thereof; and b. said piston has one end thereof adapted to be in seating engagement with said seat on the interior surface of said one of said suction valve first and second valve plates when in a first position closing said suction valve ports.

8. An unloader assembly as set forth in claim 7 wherein said unloader piston has a bore therethrough permitting communication through said piston and between the compressor suction chamber and said clearance bottle when said piston is in a second position opening said suction valve ports.

9. An unloader assembly as set forth in claim 8 wherein:

a. said piston is connected to an elongated activating shaft extending through said clearance bottle aperture; and b. said clearance bottle valve is mounted on an elongated tubular valve shaft sleeved on and slideable along said activating shaft.

10. An unloader assembly as set forth in claim 9 wherein:

a. said clearance bottle has a second aperture aligned with said first named aperture;

b. said activating shaft extends through said second aperture in said clearance bottle; and c. said tubular valve shaft extends through said second aperture in said clearance bottle.

11. An unloader assembly as set forth in claim 6 wherein:

a. said clearance bottle has a second aperture aligned with said first named aperture;

b. said piston is connected to an elongated activating shaft extending through said clearance bottle first named aperture and said second aperture;

c. said clearance bottle valve is mounted on an elongated tubular valve shaft sleeved on and movable along said activating shaft; and d. said tubular valve shaft extends through said clearance bottle second aperture.

12. An unloader assembly as set forth in claim 11 wherein said unloader piston has a bore therethrough permitting communication through said piston and between the compressor suction chamber and said clearance bottle when said piston is in the second position opening said suction valve ports.

13. An unloader assembly as set forth in claim 12 wherein:

a. one of said suction valve first and second valve plates has a seat on the interior surface thereof; and b. said piston has one end thereof adapted to be in seating engagement with said seat on the interior surface of said one of said suction valve first and second valve plates when in a first position closing said suction valve ports; and c. said seat on the interior surface of said one of said suction valve first and second valve plates and said piston one end have corresponding surfaces.

* * * * *